US005818681A

United States Patent [19]

Futsuhara et al.

[11] Patent Number: 5,818,681

[45] Date of Patent: Oct. 6, 1998

[54] ELECTROMAGNETIC RELAY DRIVE CIRCUIT

[75] Inventors: Koichi Futsuhara; Masayoshi Sakai, both of Urawa, Japan

[73] Assignee: The Nippon Signal Co., Ltd., Tokyo, Japan

[21] Appl. No.: 737,364

[22] PCT Filed: Mar. 29, 1996

[86] PCT No.: PCT/JP96/00866

§ 371 Date: Nov. 5, 1996

§ 102(e) Date: Nov. 5, 1996

[87] PCT Pub. No.: WO96/30923

PCT Pub. Date: Mar. 10, 1996

[30] Foreign Application Priority Data

Mar. 31, 1995 [JP] Japan ..... 7-076597
Jun. 29, 1995 [JP] Japan ..... 7-164318

[51] Int. Cl.[6] ..... H01H 47/28

[52] U.S. Cl. ..... 361/179; 361/78

[58] Field of Search ..... 361/179, 166, 361/167, 160, 170, 171, 1, 78, 86, 87

[56] References Cited

U.S. PATENT DOCUMENTS

| | | | |
|---|---|---|---|
| 4,291,359 | 9/1981 | Dieterle | 361/173 |
| 4,661,880 | 4/1987 | Futsuhara | 361/93 |
| 5,027,114 | 6/1991 | Kawashima et al. | 340/941 |
| 5,345,138 | 9/1994 | Mukaidono et al. | 307/326 |
| 5,559,664 | 9/1996 | Dogul et al. | 361/160 |

FOREIGN PATENT DOCUMENTS

| | | |
|---|---|---|
| 60-195832 | 10/1985 | Japan . |
| 2-123910 | 5/1990 | Japan . |
| 4-14452 | 3/1992 | Japan . |
| 5-40541 | 6/1993 | Japan . |
| 06331679 | 12/1994 | Japan . |
| WO94/23303 | 10/1994 | WIPO . |
| WO94/23496 | 10/1994 | WIPO . |
| WO95/14304 | 5/1995 | WIPO . |

*Primary Examiner*—Jeffrey A. Gaffin
*Assistant Examiner*—Sally C. Medley
*Attorney, Agent, or Firm*—Wolf, Greenfield & Sacks, P.C.

[57] ABSTRACT

The invention relates to an electromagnetic relay drive circuit which generates an electromagnetic relay excitation signal after first verifying that the electromagnetic relay make contact points are off. A forced-operation electromagnetic relay with make contact points and break contact points having complementary relationship with each other is used, and when the break contact points are on, that is to say the make contact points are off, a trigger input signal of logic value "1" with a predetermined level range is applied to a trigger input terminal of a self hold circuit. When an input signal IN of logic value "1" within a predetermined level range is applied to a reset terminal while the trigger input signal is being applied, the relay is excited and the make contact points switch on.

9 Claims, 10 Drawing Sheets

ELECTROMAGNETIC RELAY DRIVE CIRCUIT

TECHNICAL FIELD

The present invention relates to an electromagnetic relay drive circuit for driving an electromagnetic relay fitted to a control circuit, which takes safety into consideration. In particular, the present invention relates to a fail-safe electromagnetic relay drive circuit which takes into consideration faults due to fusing of the electromagnetic relay contact points.

BACKGROUND ART

In general, it is necessary with drive control systems for machines where safety is of concern, that the configuration to be such that a high energy output indicating safety is received when, for example, a movable region of a machine is in a safe condition (a safe condition even if the machine is operating). This is because with a control system wherein a high energy output is received when the movable region of the machine is in a danger condition (a danger condition when the machine is operating), then if a fault occurs in the constituent elements of the control system so that the high energy output ceases to be produced, or the generated high energy output is not received, then since no high energy output is received, a safe condition is judged and control for the safe condition (control for operation of the machine) is carried out, even though the movable region of the machine may be in a dangerous condition. On the other hand, with a control system configured such that a high energy output is received when the movable region of the machine is in a safe condition, then even if the high energy output ceases due to a fault in the constituent elements of the system, since non receipt of a high energy output has the meaning of a danger condition, then the danger condition cannot be mistaken for a safe condition, as with the beforementioned arrangement. Therefore, when safety information is represented by two values with a logic value of "1" for the safe condition and a logic value of "0" for the unsafe condition, the logic value of "1" must be transmitted as a high energy condition, and the logic value of "0" as a low energy condition or zero. For example, in the case where the release of a brake is carried out at the time of safety to thereby start the operation of a movable portion of a machine, at this time the energy for brake release must be a high energy condition meaning safety. This way of thinking is disclosed for example in U.S. Pat. No. 5,345,138.

With drive control systems for machines wherein safety is of concern, an electromagnetic relay is often used. In this case, the construction is such that when the movable region of the machine is in a safe condition, a high energy condition output indicating safety is received, thus switching on the make contact points of the electromagnetic relay to enable operation of the machine.

For example, with an electromagnetic relay drive circuit wherein safety information output from a sending side, is transmitted in a high energy condition to a receiving side electromagnetic relay via external line terminals to thereby advise of a safe condition, then a high energy output is generated from the sending side when safety is indicated by the safety information, and when the remote receiving side electromagnetic relay connected by an external line portion via the external line terminals is thus excited so that the make contact points comes on, a safe condition is indicated, and for example, an operation permit signal is output for a movable portion of a machine.

However, in the case where an electromagnetic relay is used in the transmission of safety information, faults such as fusing of the relay contact points must be carefully considered. A construction is therefore required which can check for the presence of contact point fusion in the electromagnetic relay, and output an operation permit signal for the movable portion of a machine only when there is no contact point fusion and the movable region of the machine is in a safe condition, and which does not err on the danger side, even in the event of contact point fusion.

Moreover, to make a fail-safe circuit construction which transmits high energy condition safety information via an external line portion using electromagnetic relay contact points, then as well considering fusion of the relay contact points, it is also necessary to consider short circuiting between the external line terminals.

In considering a short circuit fault between the external line terminals, then a method as illustrated by FIG. 1(*a*) must be considered. In FIG. 1, contact points "r" are on when safety is indicated, and off when unsafe, terminals A, A' and B, B' are external line terminals for transmitting a signal sent by means of the contact points "r" to an electromagnetic relay on the receiving side, while E is a power source for driving the electromagnetic relay. In the case as shown by the method of FIG. 1(*a*) where the power source E for driving the electromagnetic relay is on the transmission side, then even with an erroneous short circuit between the external line terminals A, B or between the terminals A', B', the electromagnetic relay will never be excited (not excited here means that the movable region is in a danger condition, hence the circuit errs to the safe side). On the other hand, with the method of FIG. 1(*b*) where the power source E for driving the electromagnetic relay is on the receiving side, then in a worst case scenario with an erroneous short circuit between the external line terminals A, B or between the terminals A', B', the electromagnetic relay will be excited (excited here means that the movable region is in a safe condition, hence the circuit errs to the danger side) even if the contact points "r" are not closed (the danger condition). Consequently, to construct a control system which uses an external line portion taking safety into consideration, then the method of FIG. 1(*a*) must be used.

Moreover, with load drive control systems for driving a load such as a solenoid, there is disclosed for example in Japanese Unexamined Patent Publication No. 6-331679, and PCT/JP 93/01703, load drive circuits having a semiconductor switch and electromagnetic relay contact points disposed in series in a load power supply circuit for fail-safe drive of a load, with short circuiting of the semiconductor switch taken into consideration.

With the basic operation of such conventional load drive circuits, the construction is such that at the time of driving the load, then when the drive signal for the load is input, a current is not supplied to the load until the contact points of the electromagnetic relay have first come on followed by the semiconductor switch coming on, while at the time of stopping the power to the load, then when the load drive signal stops the reverse occurs, with the semiconductor switch going off first and the power supply to the load stopping, after which the electromagnetic relay contacts go off. In the case where the load current cannot be switched off due to a short circuit fault occurring in the semiconductor switch, then the electromagnetic relay contact points go off, thus enabling the supply to the load to be shut off.

With these conventional load drive circuits, a sensor for monitoring the off condition of the semiconductor switch and the relay contact points is connected in parallel with the semiconductor switch and the relay contact points, and a signal source for the sensor is provided separate from the load drive power source, the construction being such that a signal sent from the signal source is received when the semiconductor switch and the relay contact points are both off, thus verifying the off condition of the semiconductor switch and the relay contact points. Since with this arrangement, the sensor signal source is provided separate from the load drive power source, then to avoid interference to the transmission of the sensor signals due to the load drive power source, a capacitor is used to isolate the load drive power source from the sensor portion. However, there is the problem that if a short circuit fault occurs in the capacitor, then when the semiconductor switch and the relay contact points are off, a large leakage current can flow to the load via the sensor portion.

For example, in the case of driving a load such as a solenoid valve, then normally the coil current value for the solenoid valve is different for when the valve is switched on to when the valve is switched off. This difference in current value is referred to as hysteresis. In particular, when the number of windings in the coil of the solenoid valve is made large in order to switch the valve on with a small coil current, the hysteresis becomes large. If the hysteresis becomes too large and it is difficult to quickly switch off the valve with a small current, the abovementioned leakage current in the sensor portion at the time of a short circuit fault in the capacitor becomes a problem.

That is to say, if a short circuit fault occurs in the capacitor when the semiconductor switch and the relay contact points are to be switched off, then a leakage current can flow via the sensor portion, causing a delay in the response for switching off the valve. In particular, with a mechanical press or the like, such a delay in valve switch off response results in a delay in stopping the press slide, so that under emergency stopping for example there is the possibility of the slide not stopping in time.

In PCT/JP 93/01703, a technique is disclosed wherein a very small current is supplied directly from the load drive power source to a sensor portion used to verify the off condition of a semiconductor switch. In this case, since the capacitor does not intervene then it is not necessary to consider the abovementioned drop in load switch off response due to a leakage current at the time of a short circuit in the capacitor.

However, in this case, since there is no construction for verifying the off condition of the relay contact points, then contact points which essentially never fuse must be used for the relay contact points.

In PCT/JP 93/01703, a method is also given for monitoring the off condition of a switch using a light beam sensor. While it is possible with this method to verify the off condition of the electromagnetic relay, the necessity of providing an optical sensor in the electromagnetic relay is inconvenient.

In view of the above problems, it is an object of the present invention to provide an electromagnetic relay drive circuit having a fail-safe construction which verifies the off condition of the relay contact points by using a forced-operation electromagnetic relay, thus avoiding the need to consider fusion faulting of the contact points of the electromagnetic relay.

DISCLOSURE OF THE INVENTION

Accordingly, with the present invention, an electromagnetic relay drive circuit which excites an electromagnetic relay depending on a high energy condition input signal of logic value "1" generated based on safety information, to thereby switch on the relay contact points comprises: an electromagnetic relay having make contact points which switch on at the time of excitation and break contact points which switch on at the time of non excitation, the make contact points and break contact points being linked together to thus have a complementary relationship; a self hold device which generates an output if a high energy condition trigger input signal of logic value "1" is input to a trigger terminal thereof while the input signal is being input to a reset terminal thereof, and which self holds the trigger input signal; an excitation output generating device for generating an excitation output for switching on the electromagnetic relay make contact points, based on an output from the self hold circuit; and a trigger input signal generating device for inputting the trigger input signal to the trigger terminal of the self hold device via the electromagnetic relay break contact points.

With such a construction, then when the electromagnetic relay break contact points are on, in other words when the electromagnetic relay make contact points are off, a high energy condition trigger input signal of logic value "1" is input to the trigger terminal of the self hold circuit. The electromagnetic relay is therefore not driven on until it is first verified that the make contact points are off, that is, the contact points have not fused.

Moreover, the construction may be such that: the excitation output from the excitation output generating device located on a sending side, is transmitted to the electromagnetic relay located on a receiving side via an external line portion connected by external line terminals, the external line portion comprising a first external line portion and a second external line portion, the first external line portion connecting between the excitation output generating device and the electromagnetic relay, and the second external line portion respectively connecting between one end of a series circuit of a resistor and the break contact points located on the receiving side and the trigger input signal generating device located on the sending side, and the other end of the series circuit and the trigger terminal of the self hold device located on the sending side; and the self hold device generates an output only when the respective signal levels of the reset input signal and the trigger input signal are within predetermined threshold value ranges previously set for each terminal.

With such a construction, it is possible to have a condition wherein the electromagnetic relay is not excited (a condition erring to the safe side), even if the external line terminals are shorted due to an erroneous connection, while still being able to verify if there is a fusion fault between the electromagnetic relay make contact points. Hence fail-safe characteristics at the time of a short circuit fault of the external line terminals can also be ensured. That is to say, at the time of initial operation of the electromagnetic relay, then for example if the connections of the external line terminals of the first external line portion are shorted due to an erroneous connection, the output from the excitation output generating device will not be transmitted to the electromagnetic relay, and hence the electromagnetic relay will not be excited, and an output indicating safety not produced. Also, if the external line terminals of the second external line portion are short circuited, the trigger input signal level being a voltage based on the trigger input signal generating device, rises due to disappearance of the resistance voltage drop, and thus falls outside of the threshold value range for the trigger terminal of the self hold device. Hence the electromagnetic relay is not excited, and the safety information is not output.

Furthermore, the construction may be such that a trigger stabilizing device is disposed between the trigger terminal of the self hold device and the series circuit of the electromagnetic relay break contact points and the resistor, for maintaining the trigger input signal at a level within the threshold value range for a fixed period of time when the break contact points are opened. In this way, when the break contact points are linked to the on operation of the make contact points to go off, then the trigger input signal can be maintained at a level within the threshold value range for a fixed period of time. Hence the start-up operation when the electromagnetic relay is excited, can be stabilized and the reliability of the electromagnetic relay drive circuit thus improved.

Moreover, the construction may be such that the excitation output generating device comprises: an amplifier for amplifying an alternating current output from the self hold device; a transformer which takes the amplified output from the amplifier; and a rectifying circuit for rectifying the output from the transformer, and the excitation output is generated from the rectifying circuit.

By using transformer coupling in this way, a fault wherein the electromagnetic relay is continuously excited can be prevented.

With the invention according to claim 5, the electromagnetic relay make contact points are inserted in a load power supply circuit in series with a semiconductor switch, and the trigger input signal generating device generates a trigger input signal of logic value "1" when the semiconductor switch is off and the electromagnetic relay break contact points are on, the construction being such that when an output from the self hold device is generated due to input of the trigger input signal, the semiconductor switch comes on after the excitation output generating device excites the electromagnetic relay, while when the output from the self hold device stops, the electromagnetic relay is non-excited after the semiconductor switch goes off.

With such a construction, when the electromagnetic relay make contact points and the semiconductor switch are both off, then the break contact points are definitely off and a trigger input signal of logic value "1" is generated from the trigger input signal generating device so that the trigger input to the self hold device becomes a logic value "1". In this condition, if an input signal of logic value "1" is input as a reset input to the self hold device, then the self hold device generates an output. As a result, the electromagnetic relay is excited by means of the excitation output generating device so that the make contact points come on, after which the semiconductor switch comes on and the load power supply is switched on. When the make contact points are switched on, the break contact points are switched off. However the output from the self hold device is self held and thus continues so that the make contact points and the semiconductor switch are maintained in the on condition. If the input signal stops, then the output from the self hold device stops, and after the semiconductor switch goes off, the electromagnetic relay make contact points go off, and the power supply to the load stops Since in this way the power supply to the load can be controlled after first verifying from the electromagnetic relay break contact points that the make contact points are off, then the fail-safe characteristics at the time of a contact points fusion fault can be ensured, and reliability of the load drive circuit improved.

Moreover, the construction may be such that the trigger input signal generating device basically incorporates a semiconductor switch monitoring device wherein energy is supplied between contact points of the semiconductor switch so that when the semiconductor switch is off a receive signal level becomes a high level based on the supplied energy, and a switch off detection signal of logic value "1" is generated, and when the semiconductor switch is on, the receive signal level becomes a low level based on the supplied energy, and the output becomes a logic value of zero and the switch off detection signal is stopped; and the arrangement is such that a logical product signal of the switch off detection signal of the semiconductor switch monitoring device, and a make contact points off detection signal based on switching on of the electromagnetic relay break contact points, is generated as a trigger input signal.

Moreover, the construction may be such that the semiconductor switch monitoring device incorporates a photocoupler for supplying energy between the contact points of the semiconductor switch and generating an alternating current light received output based on the supplied energy when the semiconductor switch is off, and a voltage doubler rectifying circuit for voltage doubler rectifying the alternating current output from the photocoupler, and the rectified output from the voltage doubler rectifying circuit is made the switch off detection signal. In this way, the drive power source for the load and the drive power source for the semiconductor switch and the electromagnetic relay can be made separate power sources.

Furthermore, the construction may be such that an output to the electromagnetic relay and an output to the semiconductor switch, produced in the excitation output generating device, are supplied from the output of the self hold device via a transformer, and hence a fault wherein the electromagnetic relay is continuously excited can be prevented.

Moreover, the construction may be such that the excitation output generating device supplies an output from the transformer to the electromagnetic relay via a first rectifying circuit, and rectifies a part of the output from the transformer in a second rectifying circuit and supplies this as a control signal to the semiconductor switch via other make contact points of the electromagnetic relay provided separate from the make contact points, and wherein a discharge time constant of the first rectifying circuit is set larger than a discharge time constant of the second rectifying circuit.

With such a construction, since the control signal is supplied to the semiconductor switch via the relay contact points, then the switching on of the electromagnetic relay before the semiconductor switch can be ensured.

Moreover, the construction may be such that the electromagnetic relay has second make contact points, arranged separate from first make contact points inserted in the load power supply circuit in series with the semiconductor switch and linked with the break contact points, and the trigger input signal generating device comprises a photocoupler for supplying energy between contact points of the semiconductor switch and generating an alternating current light received output based on the supplied energy when the semiconductor switch is off, and a voltage doubler rectifying circuit for voltage doubler rectifying the alternating current output from the photocoupler, the construction being such that an output terminal of the voltage doubler rectifying circuit is connected to the trigger terminal of the self hold circuit, and the break contact points are disposed between an output terminal of the light receiving element of the photocoupler and a power source so that the power source is connected to the light receiving element when the break contact points are on, and the excitation output generating device generates an excitation output for the electromagnetic relay via a transformer based on an output from the self hold circuit, and generates a control signal for the semiconductor switch by means of a logical product computation device which carries out a logical product operation on an output signal generated based on the switching on of the second make contact points, and the input signal.

With such a construction, a comparatively large current can flow in the electromagnetic relay contact points, and hence it is possible to use contact points such as silver cadmium oxide (AgCdO) contact points, which are resistant to fusion faulting but which are susceptible to poor contact unless a relatively large current flows.

BEST MODE FOR CARRYING OUT THE INVENTION

As follows is a description of embodiments of the present invention with reference to the drawings.

Figure 2:
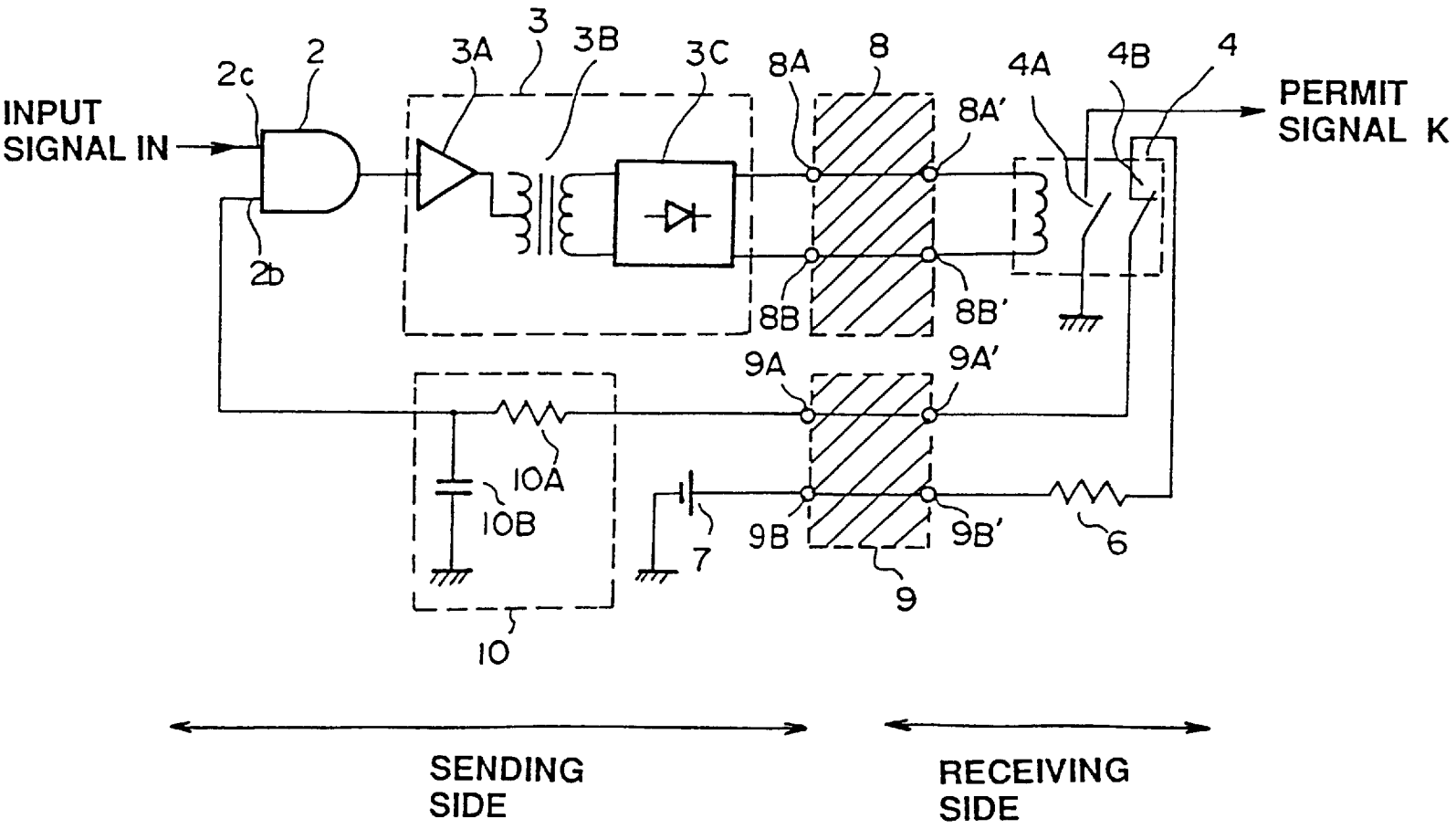
FIG. 2 is a circuit diagram of a first embodiment of the present invention.

In FIG. 2 showing a circuit of a first embodiment, an input signal IN which is output based for example on information of whether or not there is danger or safety when a movable portion of a machine is being driven, is a voltage signal of a high energy condition within a predetermined threshold value range set relative to a reset terminal 2*a* of a self hold circuit 2 (shown as an AND gate which has a logical product function relative to an input signal) serving as a self hold device to be described later, when indicating safety, and is a signal of a low energy condition (being zero voltage with the present embodiment) which is outside of the threshold value range, when indicating danger.

The self hold circuit 2 has two input terminals, namely a reset terminal 2*a* which takes the input signal IN, and a trigger terminal 2*b* which takes a voltage based on a voltage of a drive power source 7 serving as a trigger input signal generating means to be described later, the construction being such that predetermined threshold value ranges are set beforehand for the reset terminal 2*a* and the trigger terminal 2*b* relative to the signal levels to be input to each, and only when the two input signal levels are simultaneously within the threshold value ranges does the circuit oscillate. Basically, a two input fail-safe window comparator is used, with an AC output therefrom rectified and fed back to the trigger terminal to self hold the trigger input. This fail-safe window comparator comprises a plurality of transistors and resistors, and has a fail-safe construction such that if a fault occurs in the constituent elements of the circuit, an AC output is not produced. Such a circuit, its operation, and the fail-safe characteristics are given for example in U.S. Pat. No. 5,345,138, U.S. Pat. No. 4,661,880, U.S. Pat. No. 5,027,114, and in International Patent Publication No. WO94/23303. Moreover, International Patent Publication No. WO94/23303, and WO94/23496 disclose a self hold circuit using such a window comparator.

An AC-DC conversion circuit 3, serving as an excitation output generating device, comprises an amplifier 3A for amplifying the AC output from the self hold circuit 2 up to a sufficient output level to excite an electromagnetic relay 4 (to be described later), a transformer 3B, and a rectifying circuit 3C for DC converting the amplified AC output. If the AC output from the self hold circuit 2 is at a sufficient output level to excite the electromagnetic relay 4, then the amplifier 3A and the transformer 3B are not really necessary.

The electromagnetic relay 4 has make contact points 4A which come on when excited by the DC output from the AC-DC conversion circuit 3, and break contact points 4B which come on when not excited, the make contact points 4A and the break contact points 4B being linked by provision of a forced guide for guiding the break contact points 4B forcibly to the opposite off or on position when the make contact points 4A are on or off. The construction is thus such that if a fusion fault occurs in the make contact points 4A, the break contact points 4B will not close. Such an electromagnetic relay is referred to as forced-operation electromagnetic relay.

The forced-operation electromagnetic relay is an electromagnetic relay having make contact points (excited contact points) and a break contact points (non excited contact points), arranged such that if fusion occurs in the make contact points, then the break contact points will never come on while in this condition and conversely, if fusion occurs in the break contact points, then the make contact points will never come on while in this condition. Such an electromagnetic relay is marketed for example by the German Hengstler Company, and is shown as a compulsory guide contacts relay in U.S. Pat. No. 4,291,359.

Switching on the make contact points 4A causes an operation permit signal K to be output to the movable portion of the machine as safety information. Since the electromagnetic relay 4 is located for example on a receiving side which is remote from the self hold circuit 2 and the AC-DC conversion circuit 3 on a sending side, then the AC-DC conversion circuit 3 and the electromagnetic relay 4 are connected by a first external line portion 8 (exposed section). The first external line portion 8 has sending side external line terminals 8A, 8B and receiving side external line terminals 8A', 8B', connected by respective external lines between the terminals 8A, 8A', and between the terminals 8B, 8B'. A resistor 6 located on the receiving side, is connected to one end of the break contact points 4B. The drive power source 7 for applying an input voltage to the trigger terminal 2*b,* is located on the sending side, and is connected to the resistor 6 via a second external line portion 9, the break contact points 4B, and the resistor 6. The second external line portion 9 (exposed section) has sending side external line terminals 9A, 9B and receiving side external line terminals 9A', 9B', connected by respective external lines between, the external line terminal 9A connected to the trigger terminal 2*b* and the external line terminal 9A' connected to the other end of the break contact points 4B, and between the external line terminal 9B connected to the drive power source 7 and the external line terminal 9B' connected to the resistor 6. An integration circuit 10, serving as a trigger stabilizing device and disposed between the trigger terminal 2*b* and the external line terminal 9A, comprises a resistor 10A connected in series between the trigger terminal 2*b* and the external line terminal 9A, and a capacitor 10B disposed between a position between the resistor 10A and the trigger terminal 2*b,* and the earthed side of the circuit.

A description of the operation with the above construction will now be given.

In the situation prior to input of the input signal IN as a high energy condition signal indicating that a movable region of the machine is in a safe condition, a low energy condition input signal is input to the reset terminal 2*a* of the self hold circuit 2. Since this input signal level is outside the predetermined threshold value range for the reset terminal 2*a,* then there is no AC output from the self hold circuit 2, and hence the electromagnetic relay 4 connected thereto via the AC-DC conversion circuit 3 and the first external line portion 8 between the external line terminals 8A—8A', and 8B—8B', is in the non excited condition. Consequently the make contact points 4A of the electromagnetic relay 4 are off, and a permit signal K is not output from the make contact points 4A. However, since the break contact points 4B are on, the voltage of the drive power source 7 is applied to the trigger terminal 2*b* of the self hold circuit 2 from the drive power source 7 via the second external line portion 9 between the external line terminals 9B—9B', the resistor 6, the break contact points 4B, the second external line portion 9 between the external line terminals 9A—9A', and the integration circuit 10. In this condition, when a high energy condition input signal IN is input to the reset terminal 2*a,* the reset input signal level and the trigger input signal level (from the voltage of the drive power source 7) are both within the predetermined threshold value ranges respectively set for the reset terminal 2*a* and the trigger terminal 2*b,* and hence a two input logical product computation is carried out so that the self hold circuit 2 oscillates and is self held. The AC output from the self hold circuit 2 is input to the amplifier 3A and the transformer 3B and amplified up to an output level sufficient to excite the electromagnetic relay 4, and the AC signal is then converted to a DC signal by the rectifying circuit 3C. The DC output is then supplied to the electromagnetic relay 4 via the first external line portion 8 between the external line terminals 8A—8A' and 8B—8B', to thereby excite the electromagnetic relay 4. At this time, the make contact points 4A come on and a permit signal K is output.

When the make contact points 4A come on, the break contact points 4B go off. As a result, the voltage from the drive power source 7 connected to the trigger terminal 2*b* via the second external line portion 9 between the external line terminals 9B—9B', the resistor 6, the break contact points 4B, the second external line portion 9 between the external line terminals 9A—9A', and the integration circuit 10, ceases to be supplied to the trigger terminal 2*b.* However, while the high energy condition input signal IN indicating safety is being supplied to the reset terminal 2*a,* then due to the self hold function of the self hold circuit 2, the oscillation of the self hold circuit 2 continues, and hence the DC output from the AC-DC conversion circuit 3 continues and the electromagnetic relay 4 remains in the excited condition. Then when the voltage of the input signal IN becomes zero, the reset input signal level falls outside of the predetermined threshold value range, and hence the oscillation of the self hold circuit 2 stops and the AC output ceases, so that the input to the AC-DC conversion circuit 3 ceases. As a result, the electromagnetic relay 4 becomes non-excited so that the make contact points 4A go off and the permit signal K ceases to be output. Moreover, at this time the break contact points 4B come on so that the voltage of the drive power source 7 is again applied to the trigger terminal 2*b.*

Regarding the setting of the threshold value ranges for the reset terminal 2*a* and the trigger terminal 2*b,* the upper limit threshold value for the reset terminal 2*a* is set to a level slightly higher than a signal level which takes into consideration normal operational changes for the high energy input level of the input signal IN, while the lower limit threshold value is set to a level which would be judged as a drop in signal level. For the trigger terminal 2*b,* if the resistance values of the resistors 6 and 10A are R6 and R10, the value of the flowing current is "i", and the output voltage from the drive power source 7 is E, then the upper limit threshold value is set to a voltage value lower than the lower of (E−iR6) and (E−iR10), and higher than {E−i(R6+R10)}, while the lower limit thresh hold value is set between {E−i(R6+R10)} and the power source potential of the self hold circuit 2. When the construction does not include the integration circuit 10, then the upper limit threshold value is set between (E−iR6) and the output voltage E from the drive power source 7, while the lower limit threshold value is set between (E−iR6) and the power source potential of the self hold circuit 2.

With such a construction using the electromagnetic relay 4 with the on and off switching of the make contact points 4A and the break contact points 4B linked, then since power supply to the electromagnetic relay 4 is carried out after verifying from the on condition of the break contact points 4B of the electromagnetic relay 4 prior to driving the electromagnetic relay 4, that the make contact points 4A are off, in other words, that the make contact points 4A are not fused, then if a fusion fault has occurred in the make contact points 4A of the electromagnetic relay 4, the electromagnetic relay 4 is not excited at start-up of the movable part of the machine. Consequently, a fail-safe electromagnetic relay drive circuit is constructed and safety improved.

A situation where the external line terminal connections of the first external line portion 8 are erroneously short circuited will now be considered. If the external line terminals 8A and 8B or 8A' and 8B' are short circuited, then the output from the AC-DC conversion circuit 3 is not transmitted to the electromagnetic relay 4, and hence the electromagnetic relay 4 is not excited and the permit signal K not output to the movable part of the machine.

The situation is also considered where the external line terminal connections of the second external line portion 9 are erroneously short circuited. First, if there is a short circuit between the external line terminals 9A–9B or between the external line terminals 9A'–9B', a voltage (E−iR10) is continuously applied to the trigger terminal 2*b* irrespective of the condition of the break contact points 4B.

However, since this voltage is larger than the upper limit threshold value of the trigger terminal 2*b,* then an output from the self hold circuit 2 is not produced. Consequently, if a short circuit occurs between the input or the output terminals of the second external line portion 9, the electromagnetic relay 4 is not excited, and the permit signal K is not output.

Moreover, if the resistor 6 or the resistor 10A are short-circuited, then the voltage input to the trigger terminal 2*b* becomes larger than the upper limit threshold value of the trigger terminal 2*b,* and hence an output from the self hold circuit 2 is not produced. Moreover, if a disconnection fault occurs in the circuit section from the drive power source 7 to the trigger terminal 2*b* of the self hold circuit 2, then the voltage input to the trigger terminal 2*b* becomes zero, which is lower than the lower limit threshold value of the trigger terminal 2*b,* and hence in the same way, an output from the self hold circuit 2 is not produced.

Figure 1A:
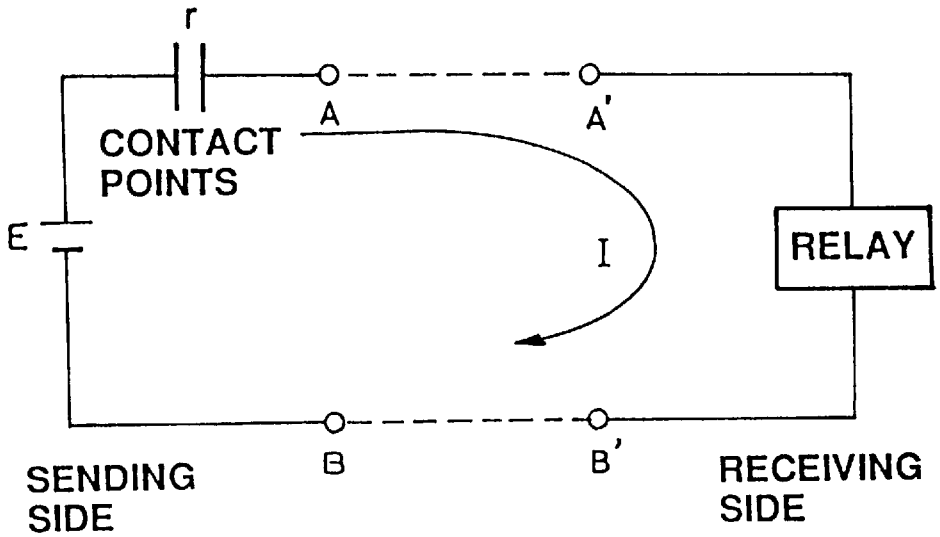
FIG. 1 is basic circuit diagrams for when information indicating safety is transmitted via an external line terminal; (a) showing a construction which takes safety into consideration, and (b) showing a construction which can err on the danger side.
Figure 1B:
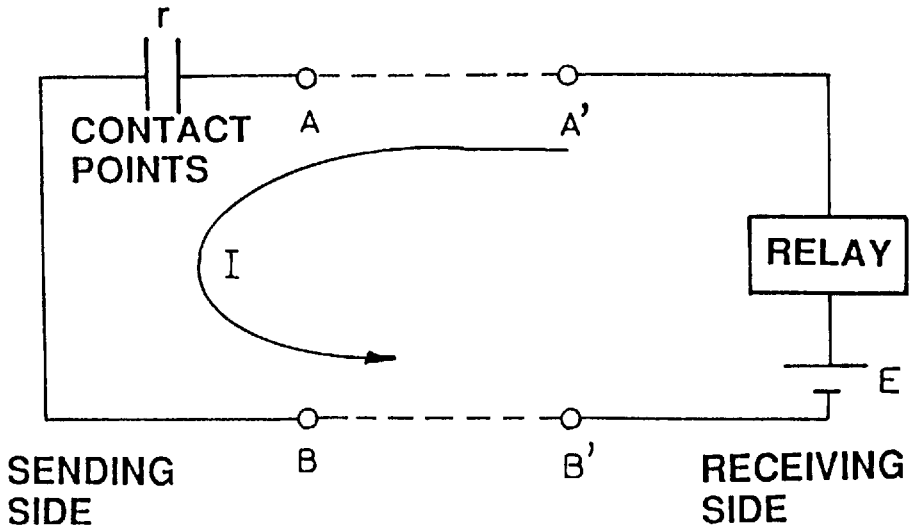

With such a construction, the circuit parts including the trigger terminal 2*b,* the break contact points 4B, and the drive power source 7, connected by means of the second external line portion 9, correspond to the circuit shown in FIG. 1(*b*). That is to say, the trigger terminal 2*b* corresponds to the relay, the break contact points 4B correspond to the contact points "r", and the drive power source 7 corresponds to the power source E. Moreover, the circuit parts including the respective inputs to the self hold circuit 2, the self hold circuit 2, and the electromagnetic relay 4, connected by means of the first external line portion 8, correspond to the circuit shown in FIG. 1(*a*). That is to say, the respective inputs to the self hold circuit 2 correspond to the power source E, the self hold circuit 2 corresponds to the contact points "r", and the electromagnetic relay 4 corresponds to the relay of FIG. 1(*a*). Consequently with the present invention, signal transmission is possible with the circuit construction shown in FIG. 1(*a*) while also including the circuit construction shown in FIG. 1(*b*), and hence if the connections of the first external line portion 8 and the second external line portion 9 (the exposed sections) are erroneously short circuited, the electromagnetic relay 4 can be kept in the non excited condition (the condition erring to the safe side).

Moreover, by providing the integration circuit 10 located between the trigger terminal 2*b* of the self hold circuit 2 and the break contact points 4B of the electromagnetic relay 4, connected thereto via the second external line portion 9, then when the break contact points 4B go off, the trigger input signal is maintained at a level within the threshold value range for a fixed period of time. Therefore the trigger input of the self hold circuit 2 does not stop until the make contact points 4A have been positively switched on. Hence the start-up operation when the electromagnetic relay 4 is excited can be stabilized, and the reliability of the electromagnetic relay drive circuit thus improved.

Next is a description of a second embodiment of the present invention.

The second embodiment is an example for a load drive circuit with an electromagnetic relay inserted in a power supply circuit for a load. The circuit diagram is shown in FIG. 3.

Figure 3:
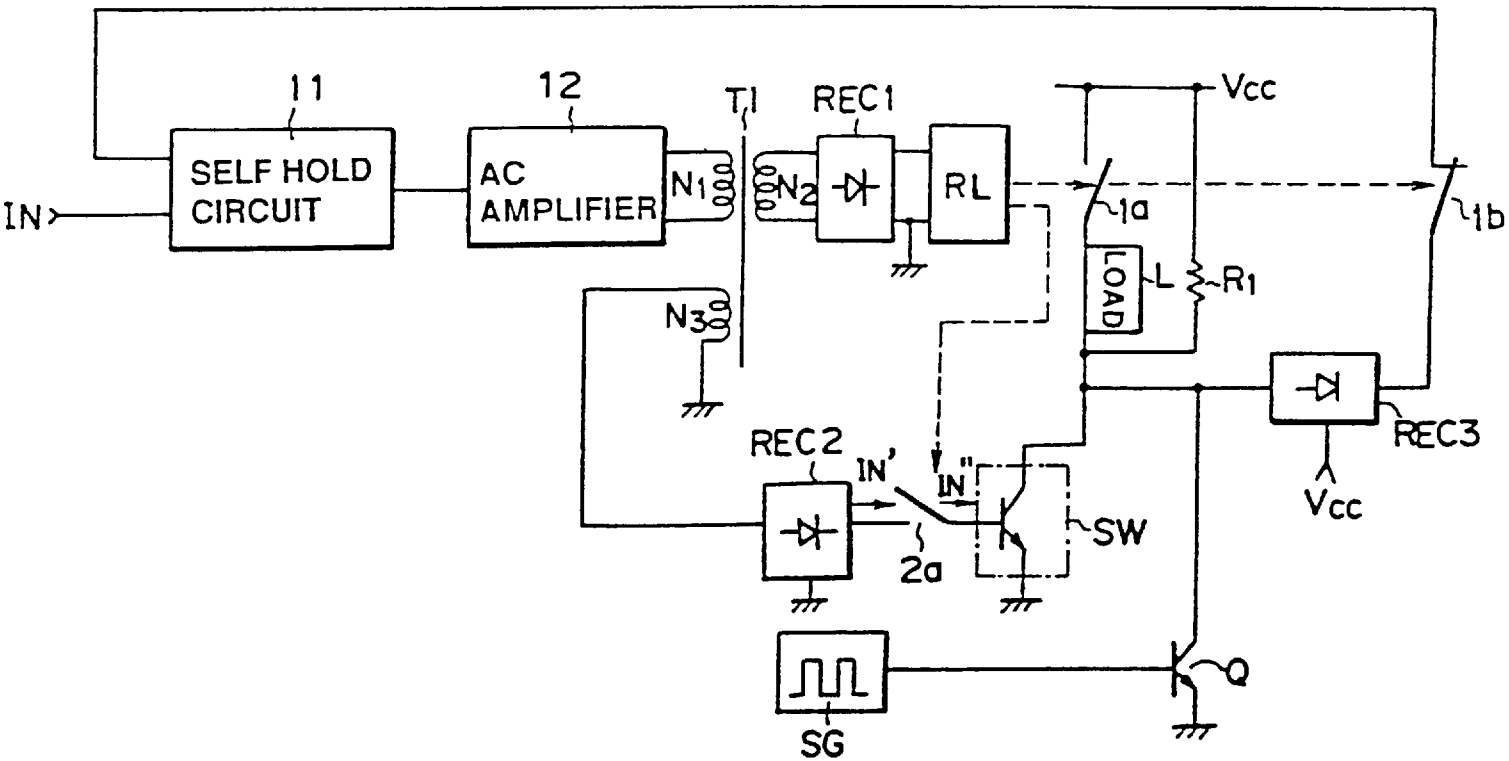
FIG. 3 is a circuit diagram of a second embodiment of the present invention.

In FIG. 3, a load L, first make contact points 1*a* of a forced-operation contacts relay RL, and a semiconductor switch SW (shown as a transistor in the figure) are connected in series in a power supply circuit for supplying a constant voltage $V_{CC}$ to the load L. The constant voltage $V_{CC}$ is supplied as energy to the output terminal (collector side) of the semiconductor switch SW via a resistor R1 connected in parallel with the first make contact points 1*a* and the load L. A transistor Q is connected in parallel with the semiconductor switch SW, and an output terminal of a signal generator SG for generating a high frequency signal is connected to the base of the transistor Q.

Figure 4:
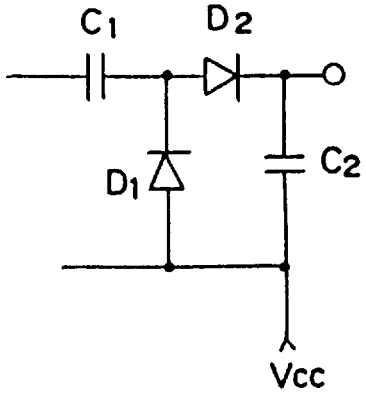
FIG. 4 is a circuit diagram of a voltage doubler rectifying circuit of the second embodiment.

A voltage doubler rectifying circuit REC3 is for voltage doubler rectifying an AC signal generated by the on/off switching of the transistor Q accompanying high frequency signal input from the signal generator SG, in the off condition of the semiconductor switch SW. The voltage doubler rectifying circuit REC3, known for example from U.S. Pat. No. 5,027,114, and International Patent Publication No. WO94/23303, has two capacitors C1, C2 and two diodes D1, D2 as shown in FIG. 4, and generates an output of the voltage $V_{CC}$ superimposed on the input signal.

Here a semiconductor switch monitoring device, which generates a semiconductor switch OFF detection signal of logic value "1" when the semiconductor switch SW is off, is made up of the resistor R1, the transistor Q, the signal generator SG and the voltage doubler rectifying circuit REC3.

An output signal from the voltage doubler rectifying circuit REC3 is input to a trigger terminal of a self hold circuit 11 serving as a fail-safe self hold device, via break contact points 1*b* of a electromagnetic relay RL. The self hold circuit 11 generates an AC output signal when a load drive signal IN is input to a reset terminal as an input signal of logic value "1" for load drive, under the condition that the break contact points 1*b* are on (indicating that the first make contact points 1*a* are off) and an output signal of logic value "1" from the voltage doubler rectifying circuit REC3 is input to the trigger input side (logical product condition for the off detection signal of the semiconductor switch SW and the off detection signal for the break contact points 1*b*). The construction is thus such that the output signal is self held by feeding back the AC output rectified signal to the trigger terminal side. Furthermore, the self hold circuit 11 has a fail safe construction, similar to that of the fail-safe self hold circuit 2, in that an AC output signal (logic value "1") is only generated when an input signal of a level higher than the power source voltage $V_{CC}$ is input, and at the time of a fault an AC signal is not generated (logic value "0"). Here a trigger input signal generating device is made up of the semiconductor switch monitoring device and the break contact points 1*b*.

The AC output signal from the self hold circuit 11 is amplified by an AC amplifier 12, then supplied to a primary winding N1 of a transformer T1 and transferred to a secondary winding N2 side. An output signal from the secondary winding N2 is rectified by a first rectifying circuit REC1 and supplied to a coil of the electromagnetic relay RL as an electromagnetic relay control signal, to thereby excite the electromagnetic relay RL. The electromagnetic relay RL (forced-operation electromagnetic relay) of this diagram has two sets of make contact points 1*a,* 2*a* which come on when excited, the first make contact points 1*a* being linked to break contact points 1*b* by a forced guide, but the second make contact points 2*a* having no linked break contact points.

The amplified output signal from the AC amplifier 12 is also input to a second rectifying circuit REC2 via a tertiary winding N3 of the transformer T1, and then rectified and output to the base of the semiconductor switch SW via the second make contact points 2*a* of the electromagnetic relay RL, as a control signal for the semiconductor switch SW.

Figure 5:
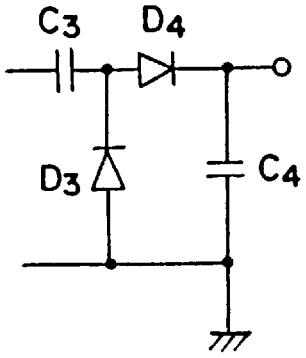
FIG. 5 is a circuit diagram of first and second rectifying circuits of the second embodiment.

Here, for the rectifying circuits REC1 and REC2, a known full wave rectifying circuit can be used, or a voltage doubler rectifying circuit as shown in FIG. 5, comprising two capacitors C3, C4 and two diodes D3, D4 can be used. A proviso is that the off response (the time from stopping input until the output stops) for the smoothing in the first rectifying circuit REC1 is made longer than the off response for the smoothing in the second rectifying circuit REC2. To achieve this, the time constant for the first rectifying circuit REC1 can be set larger than the time constant for the second rectifying circuit REC2. Basically, the electrostatic capacity of the smoothing capacitor C4 should be much larger for the first rectifying circuit REC1 than for the second rectifying circuit REC2.

If the off response is set in this way, then when the output signal from the AC amplifier 12 is cancelled with stopping of the load drive signal IN, then at first the semiconductor switch SW goes off after which the make contact points 1*a*, 2*a* of the electromagnetic relay RL go off.

Here an excitation output generating device is made up of the AC amplifier 12, the transformer T1, the first and second rectifying circuits REC1, REC2, and the second make contact points 2*a* of the electromagnetic relay RL.

The operation will now be described.

If the electromagnetic relay RL and the semiconductor switch SW are operating normally, then prior to generation of a load drive signal IN, the electromagnetic relay RL is in the non excited condition and hence the first and second make contact points 1*a* and 2*a* are off, the break contact points 1*b* are on, and the semiconductor switch SW is off. At this time, if a high frequency signal is input to the base of the transistor Q from the signal generator SG, then a current flowing via the resistor R1 is switched by the switching operation of the transistor Q, so that an AC signal is input to the voltage doubler rectifying circuit REC3. This AC signal is voltage doubler rectified by the voltage doubler rectifying circuit REC3 and input to the trigger terminal of the self hold circuit 11 via the break contact points 1*b* which are on. That is to say, the off condition of the semiconductor switch SW is verified by the output signal of logic value "1" from the voltage doubler rectifying circuit REC3, while the off condition of the first make contact points 1*a* is verified by the on condition of the break contact points 1*b*, and hence a logical product output for both off verification detection signals is input to the trigger terminal of the self hold circuit 11.

When in this condition the load drive signal IN is input to the reset terminal of the self hold circuit 11, then an AC output signal is produced in the self hold circuit 11, and this output signal is amplified by the AC amplifier 12 and then rectified by the first rectifying circuit REC1, via the transformer T1, to thereby excite the electromagnetic relay RL. As a result, the first and second make contact points 1*a* and 2*a* come on. After the second make contact points 2*a* come on, the semiconductor switch SW is switched on by the rectified output signal from the second rectifying circuit REC2. Hence no current is supplied to the load L until the instant when the semiconductor switch SW comes on. When the electromagnetic relay RL is excited, the break contact points 1*b* go off and hence the trigger input signal supplied from the voltage doubler rectifying circuit REC3 to the self hold circuit 11 is cancelled. However due to the self hold operation of the self hold circuit 11, then as long as the load drive signal IN is input, the self hold circuit 11 continues to give an output signal, and hence the load current continues to flow to the load L.

When the load drive signal IN is cancelled, the output signal from the self hold circuit 11 is cancelled so that the output signal from the AC amplifier 12 is also cancelled. Here since the off response for the smoothing in the first rectifying circuit REC1 is set to be longer than the off response for the smoothing in the second rectifying circuit REC2, then the rectified output from the second rectifying circuit REC2 is cancelled first, so that the semiconductor switch SW goes off first and the current to the load L is stopped. After this the rectified output from the first rectifying circuit REC1 is cancelled and the first and second make contact points 1*a* and 2*a* of the electromagnetic relay RL go off.

Figure 6:
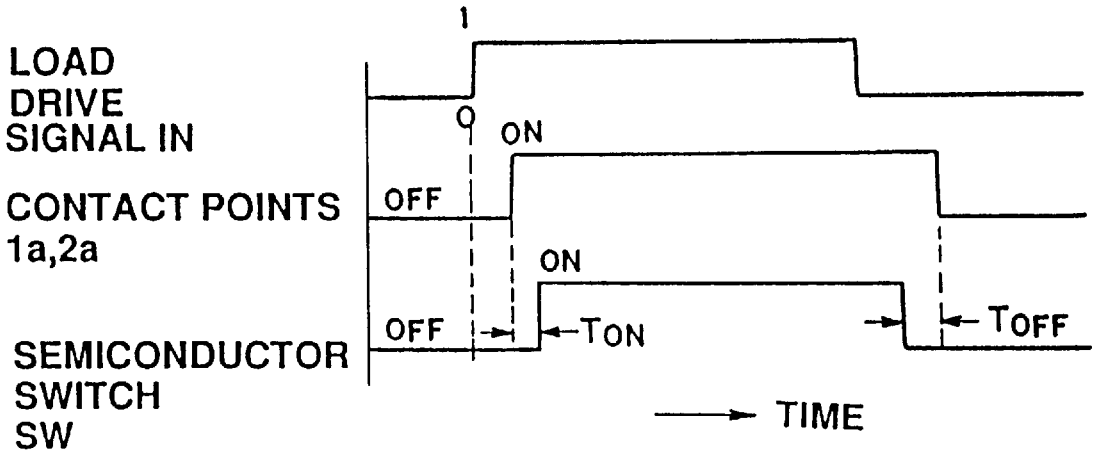
FIG. 6 is a time chart for the operation of a semiconductor switch and make contact points.

A time chart for the operation of the load drive signal IN, the two pairs of make contact points 1*a* and 2*a* of the electromagnetic relay RL, and the semiconductor switch SW is shown in FIG. 6.

After input of the load drive signal IN, the electromagnetic relay RL is excited by the rectified output from the first rectifying circuit REC1 so that the two pairs of contact points 1*a* and 2*a* come on. Once the second contact points 2*a* have come on, the rectifying operation of the second rectifying circuit REC2 starts, and after elapse of a time $T_{ON}$, the semiconductor switch SW comes on due to the output from the second rectifying circuit REC2. When the load drive signal IN is cancelled, then due to the disparity between the off responses for the first and second rectifying circuits REC1 and REC2, the output from the second rectifying circuit REC2 is cancelled and the semiconductor switch SW goes off before the two pairs of make contact points 1*a* and 2*a* go off. Then after a delay of time $T_{OFF}$, the electromagnetic relay RL becomes non excited, and both pairs of make contact points 1*a* and 2*a* go off.

With a load drive circuit of this construction, since the load current is switched on and off by the semiconductor switch SW, the first make contact points 1*a* do not directly switch the current flowing to the load (load current) on and off, and hence the likelihood of fusion of the first make contact points 1*a* is considerably reduced.

Furthermore, in the condition where the load drive signal IN is being input (the condition with the load current flowing), then in a worst case scenario where an ON fault occurs in the semiconductor switch SW, the instant the load drive signal IN is cancelled, the load current is shut off by the first make contact points 1*a*, hence drive of the load can be stopped. Once the load drive signal IN has been stopped, then even if a load drive signal IN is input, since the semiconductor switch SW is in the on condition, an output signal of logic value "1" is not generated from the voltage doubler rectifying circuit REC3. Hence, the trigger signal is not input to the self hold circuit 11, and the electromagnetic relay RL is thus not excited so there is no drive of the load L. Now, in the condition where the load drive signal IN is being input, and in a worst case scenario, both the semiconductor switch SW and the first make contact points 1*a* have an ON fault, the load current will continue to flow to the load L even if the load drive signal IN is cancelled. However with the circuit of this embodiment, such a fault is disregarded since the load current is not switched on and off directly by the first make contact points 1*a*, and hence there is little likelihood of fusion faulting of the first make contact points 1*a*.

Because of the construction with the control signal supplied to the semiconductor switch SW via the second make contact points 2*a* of the electromagnetic relay RL, then the switching on of the semiconductor switch SW after the first make contact points 1*a* come on is ensured.

Figure 7:
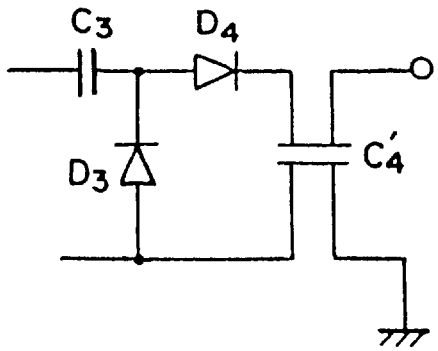
FIG. 7 is another circuit diagram for the first rectifying circuit.

When the voltage doubler rectifying circuit of FIG. 5 is used for the first rectifying circuit REC1, then if a disconnection fault occurs in the leads of the smoothing capacitor C4, the delay time $T_{OFF}$ in FIG. 6 cannot be guaranteed. To avoid this situation, a four terminal capacitor C4' as shown in FIG. 7, can be used as the smoothing capacitor, enabling an improvement in the fail-safe characteristics, and reliability of the load drive circuit.

With the circuit of the present embodiment, a condition of the first make contact points 1*a* and break contact points 1*b* is that when one set is on then the other set is always off. If the break contact points 1*b* come on while the first make contact points 1*a* are still on, the first make contact points 1*a* off detection function provided by the break contact points 1*b* loses its meaning. Normally it is difficult to guarantee the above condition with a narrow contact point gap in an electromagnetic relay. However an electromagnetic relay where this can be guaranteed, is the forced-operation contacts relay, which is different from normal electromagnetic relays.

Figure 8:
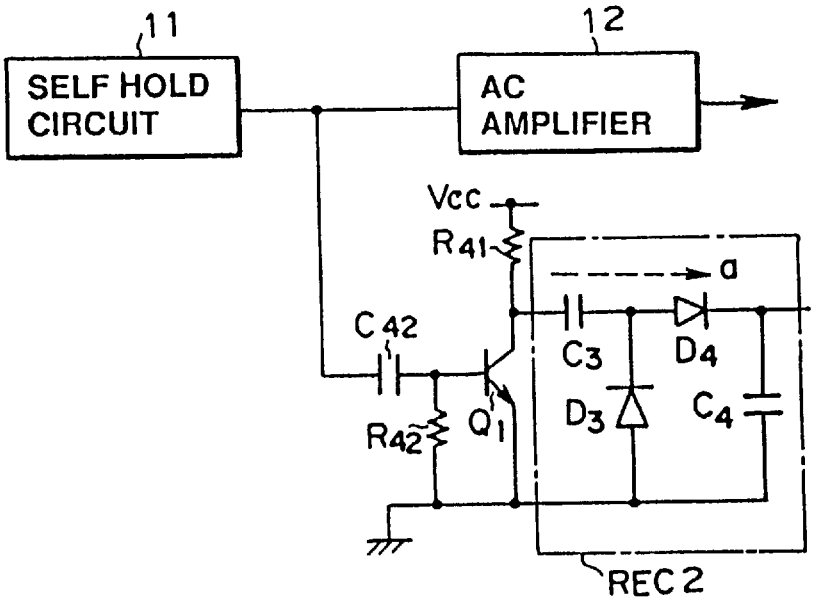
FIG. 8 is a diagram for explaining the effect of inputting a signal to the second rectifying circuit via a transformer.

Moreover, in a worst case scenario wherein a fault occurs such that the output signal from the second rectifying circuit REC2 is continuously output, then the semiconductor switch SW will be switched on and off by the second make contact points 2*a*. This is equivalent to the delay time $T_{OFF}$ in FIG. 6 approaching zero. With a construction for example as shown in FIG. 8, wherein the output signal from the self hold circuit 11 is input to the second rectifying circuit REC2 (in FIG. 8 this is shown as using the voltage doubler rectifying circuit of FIG. 5) via an amplifying circuit comprising a capacitor C42, resistors R41 and R42, and a transistor Q1, then in a worst case scenario with a short circuit fault in the capacitor C3 and a disconnection fault in the collector of the transistor Q1, the DC potential $V_{CC}$ is continuously applied to the semiconductor switch SW from the second make contact points 2*a* via the resistor R41 as shown by the dotted line "a" in FIG. 8. Such a fault wherein the signal IN' in FIG. 3 is continuously produced must not be allowed.

With the circuit of the present embodiment however, this is configured so that the input signal to the second rectifying circuit REC2 is applied via the transformer T1, and since there is insulation between the windings of the transformer T1, then this type of fault does not arise. However it does not really matter if a fault wherein the signal IN' as shown in FIG. 3 is continuously generated occurs. This is because with the present circuit, the input of the signal to the semiconductor switch SW has no relation to the switching operation of the second make contact points 2*a*, and such a fault is just the same as an output side short circuit fault of the semiconductor switch SW, where the semiconductor switch off detection signal is not produced, and hence the self hold circuit 11 is not triggered.

Figure 9:
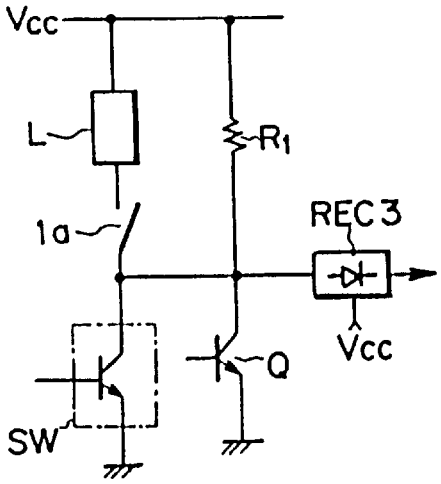
FIG. 9 is a diagram showing a modified mode for the load power supply circuit of the second embodiment.
Figure 10:
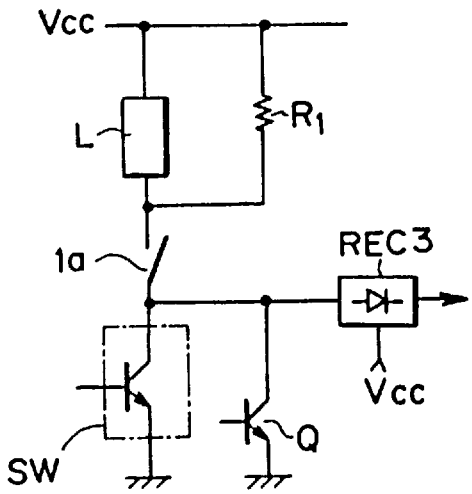
FIG. 10 is a circuit diagram of an undesirable circuit for supplying energy to the semiconductor switch.
Figure 11:
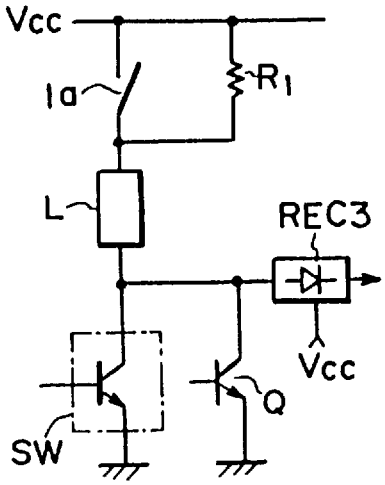
FIG. 11 is a circuit diagram of another undesirable circuit for supplying energy to the semiconductor switch.

Moreover, with the circuit of the present embodiment, as shown in FIG. 9 the location of the first make contact points 1*a* and the load L can be interchanged. However it is still necessary to supply the constant voltage $V_{CC}$ via the resistor R1 to between the series circuit of the first make contact points 1*a* and the load L, and the semiconductor switch SW. This is because with the case shown in FIG. 10, the constant voltage $V_{CC}$ would be switched on and off by the first make contact points 1*a*. Moreover, with the case shown in FIG. 11, although the output condition of the voltage doubler rectifying circuit REC3 is changed with the on and off switching of the semiconductor switch SW, since a small current can flow to the load L via the resistor R1, then there is a problem in the case for example where the load is a solenoid valve which is operated by a small current. The load resistance must therefore be sufficiently less than the resistance value of the resistor R1.

Figure 12:
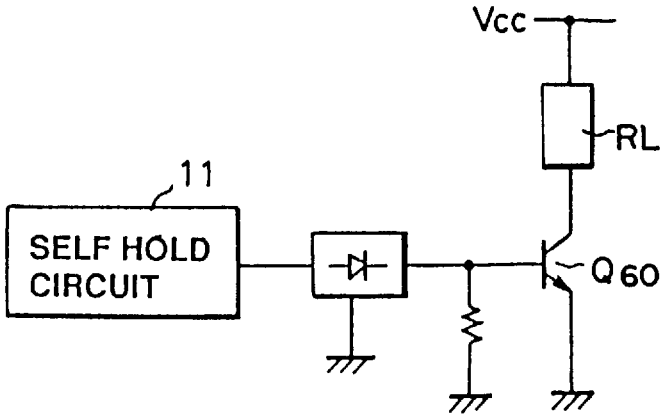
FIG. 12 is a diagram for explaining the effects of driving an electromagnetic relay via a transformer.
Figure 13:
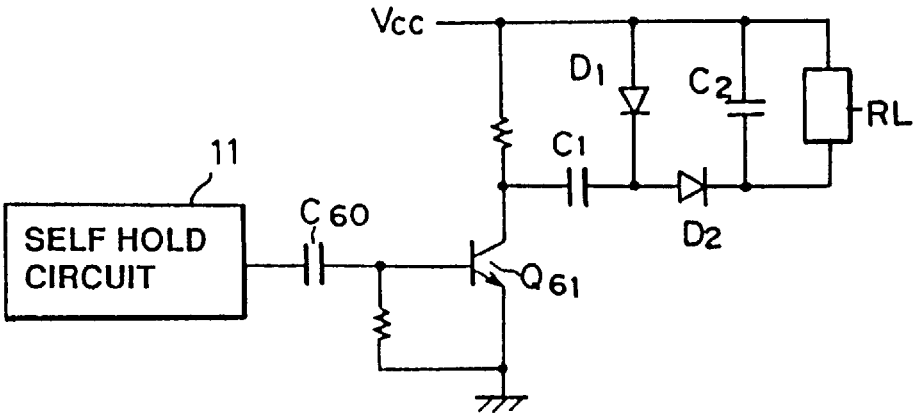
FIG. 13 is another diagram for explaining the effects of driving an electromagnetic relay via a transformer.

Considering another situation where a fault occurs such that the electromagnetic relay RL is continuously excited, then if a short circuit fault occurs in the semiconductor switch SW, power supply to the load cannot be shut off. For example, with the construction as shown in FIG. 12 wherein a transformer is not used and the output signal from the self hold circuit 11 is rectified by the rectifying circuit of FIG. 5 and amplified by a transistor Q60 to thereby drive the electromagnetic relay RL, then if an ON fault occurs in the transistor Q60 (a short circuit fault between the collector and emitter), the electromagnetic relay RL will be continuously excited. Moreover, with the construction as shown in FIG. 13 wherein the output signal from the self hold circuit 11 is amplified by an amplifying circuit made up of a coupling capacitor C60 and a transistor Q61, and then rectified by a voltage doubler rectifying circuit of the construction of FIG. 4 to thereby drive the electromagnetic relay RL, then if for example a short circuit fault occurs in the capacitor C1, the diode D2, and between the collector and emitter of the transistor Q61, (and also if a disconnection fault occurs in the diode D1), then the electromagnetic relay RL remains in the excited condition.

With the circuit of the present embodiment, since the transformer T1 is used, then these faults wherein the electromagnetic relay RL is continuously excited do not occur, and hence reliability is increased and safety performance improved.

In the case wherein a disconnection fault occurs in the resistor R1 or a fault occurs in the transistor Q, then the output signal from the voltage doubler rectifying circuit REC3 is not produced. Moreover, since the AC amplifier 12 has the output side coupled to the transformer T1, then if this is an amplifier wherein a self excitation fault cannot occur (an amplifier which does not have a normal load feedback circuit), then at the time of a fault, an AC output signal is not produced in the transformer T1.

Moreover, since the normally electromagnetic relay is constructed such that a plurality of contact points are simultaneously on or off, then if a fusion fault occurs in the second make contact points 2*a*, this results in a situation equivalent to a fusion fault occurring in the first make contact points 1*a*. However with the example circuit of FIG. 3, since the current flowing in the second make contact points 2*a* is small, then fusion faulting of the second make contact points 2*a* is of minor concern.

Figure 14:
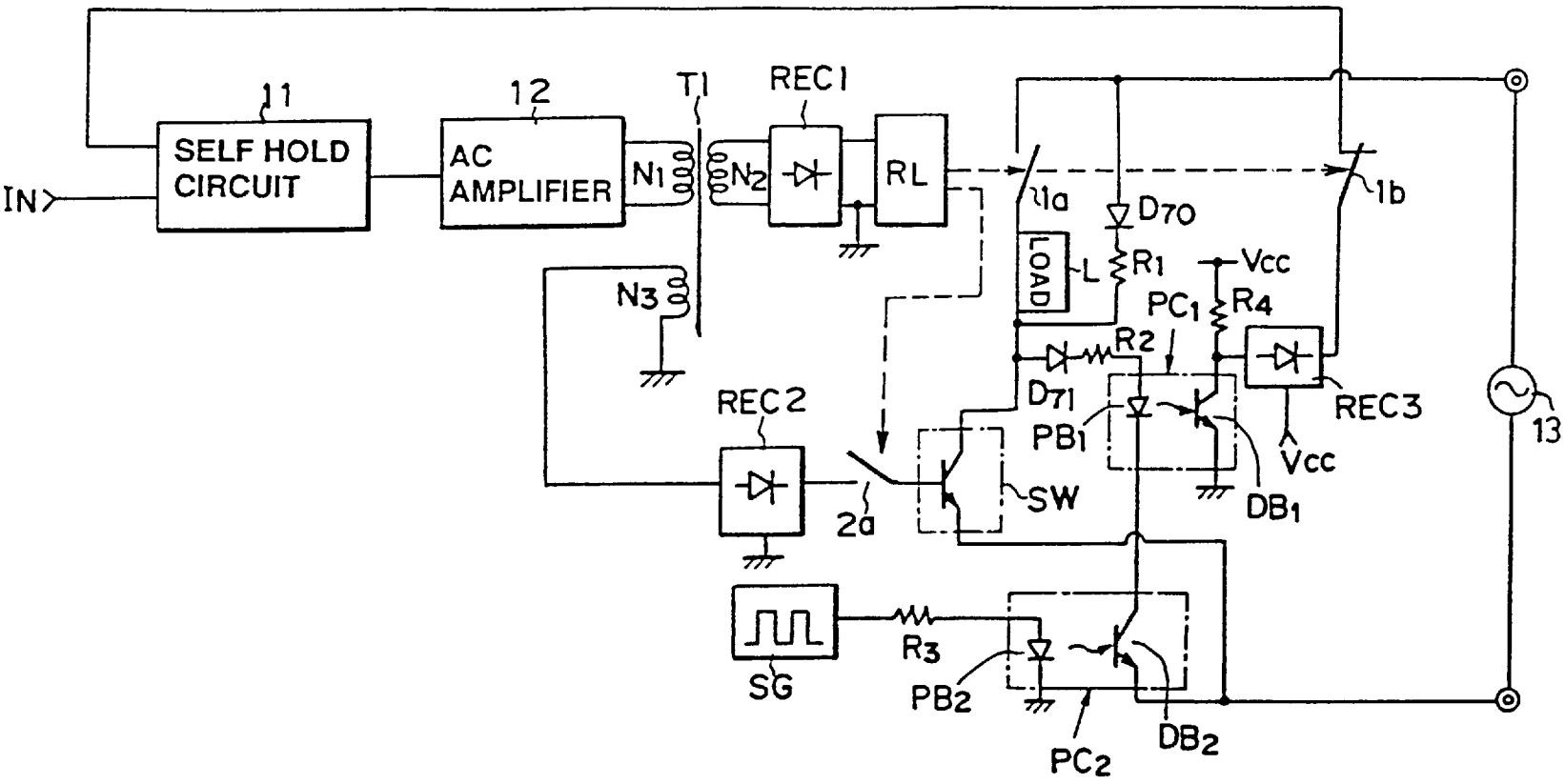
FIG. 14 is a circuit diagram showing a third embodiment of the present invention.

A third embodiment of the present invention is illustrated in FIG. 14.

In FIG. 14, the power source for the load L and the semiconductor switch SW, and the drive power source for the electromagnetic relay RL are separate power sources. Components similar to those of the second embodiment are indicated by the same symbol and description is omitted.

The construction of the third embodiment in FIG. 14 is such that the on or off verification signal for the semiconductor switch SW is extracted by a photocoupler. A power source 13 (in this example an AC power source) separate to the drive power source for the semiconductor switch SW and the electromagnetic relay RL, is connected to the series circuit of the load L, the first make contact points 1*a* and the semiconductor switch SW. A diode D70 is connected in series with the resistor R1 connected in parallel with the series circuit of the load L and the first make contact points 1*a*. A series circuit of a diode D71, a resistor R2, a light emitting diode PB1 of a first photocoupler PC1, and a photodiode DB2 of a second photocoupler PC2 is connected the semiconductor switch SW (shown by a transistor symbol in the figure, however since the power source 13 is AC, then for example a semiconductor involving a thyristor can be used for this switch). The photodiode DB2, and the light emitting diode PB2 constituting the second photocoupler PC2, are subjected to a high frequency signal from a signal generator SG via a resistor R3. The photodiode DB1 of the first photocoupler PC1 is subjected to a constant voltage $V_{CC}$ via the resistor R4, and the light received output from the photodiode DB1 is input to the voltage doubler rectifying circuit REC3. Other details of the construction are the same as for the second embodiment, and description is omitted. The diodes D70 and D71 are for rectifying.

The operation will now be explained.

When the first make contact points 1*a* and the semiconductor switch SW are both in the off condition prior to generation of the load drive signal IN, then if a high frequency signal is input to the light emitting diode PB2 of the second photocoupler PC2 from the signal generator SG, the emitted light signal is received by the photodiode DB2 of the second photocoupler PC2, and the half-wave current from the AC power source 13 flowing via the resistor R1 is switched. Provided that the semiconductor switch SW is off, this switching signal is transmitted to the photodiode DB1 via the light emitting diode PB1 of the first photocoupler PC1, and output from the voltage doubler rectifying circuit REC3 as a semiconductor switch off detection signal of logic value "1", and input via the switched on break contact points 1*b* to the self hold circuit 11 as a trigger signal. The subsequent operations are the same as for the second embodiment, namely the electromagnetic relay RL is excited so that the first make contact points 1*a* come on, after which the semiconductor switch SW comes on so that a current is supplied to the load L.

Figure 15:
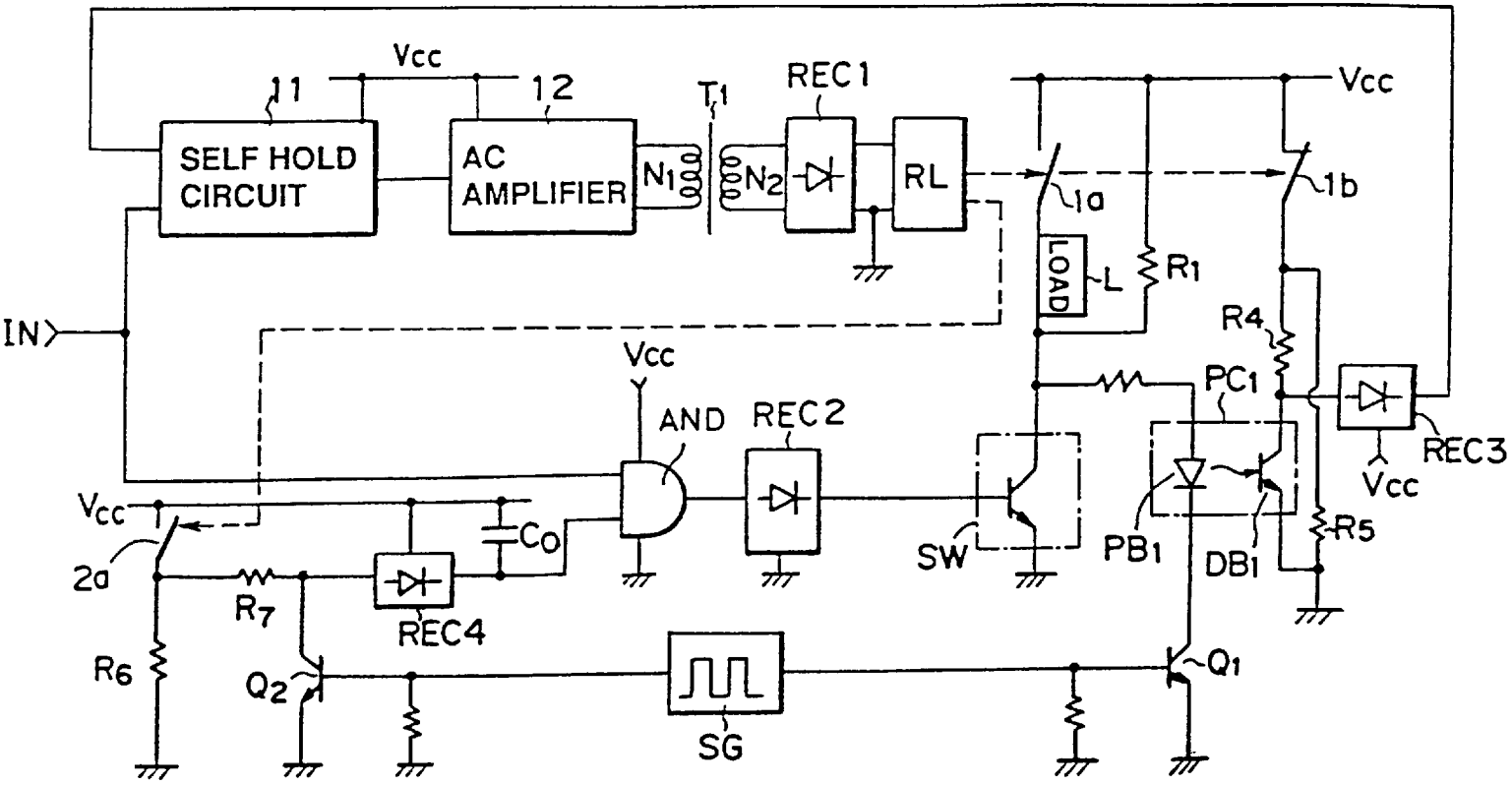
FIG. 15 is a circuit diagram showing a fourth embodiment of the present invention.

A fourth embodiment of the present invention is shown in FIG. 15.

Of the currently used electrical contact point materials, one which is particularly resistant to fusion faulting is silver-cadmium oxide (AgCdO). With this contact point material however, if the current flowing through the contacts is not large, for example less than 100 mA, then poor contact is likely.

FIG. 15 shows a load drive circuit constructed so that a comparatively large current flows through break contact points 1*b* and second make contact points 2*a*. Components similar to those of the second and third embodiments are indicated by the same symbols and description is omitted.

In FIG. 15, a constant voltage $V_{CC}$ is applied to a photodiode DB1 of a first photocoupler PC1 via break contact points 1*b* of an electromagnetic relay RL, and a resistor R4. Furthermore, a resistor R5 is connected in parallel with the photodiode DB1 and the resistor R4, being the load resistance for the photodiode DB1. The current flowing in the break contact points 1*b* is determined by the resistance value of the resistor R5. A semiconductor switch off detection signal of logic value "1" from the voltage doubler rectifying circuit REC3, based on an AC signal from the photodiode DB1, is input directly to a self hold circuit 1 as a trigger input.

When the second make contact points 2*a* are on, an AC signal accompanying the switching operation of a transistor Q2 due to a high frequency signal from a signal generator SG, is input to a voltage doubler rectifying circuit REC4. The current flowing in the second make contact points 2*a* is determined by the resistance value of a resistor R6. A resistor R7 is a load resistor for the transistor Q2.

The rectified output from the voltage doubler rectifying circuit REC4 is input to one input terminal of a logical product operation circuit AND serving as a logical product computing device, while a load drive signal IN is input to the other input terminal. The logical product operation circuit AND has a fail-safe construction such that the output becomes a logic value "0" at the time of a fault. This is because if, due to a fault in the logical product operation circuit AND, an output therefrom is produced with input of the load drive signal IN only, without the rectified output from the voltage doubler rectifying circuit REC4 being input, then the semiconductor switch SW will come on before the first make contact points 1*a* of the electromagnetic relay RL, so that the first make contact points 1*a* of the electromagnetic relay RL control the load current directly, and hence fusion faulting of the first make contact points 1*a* is likely.

A fail-safe logical product operation circuit is disclosed for example in U.S. Pat. No. 4,661,880, and International Patent Publication Nos. WO94/23303, and WO94/23496.

A capacitor $C_O$ provided on the output side of the voltage doubler rectifying circuit REC4 is for slightly delaying the time from when the second make contact points 2*a* come on until a rectified output is input to the logical product operation circuit AND. This is for reliably maintaining the delay time TON in FIG. 6. Needless to say, the off response for smoothing the rectified output from the second rectifying circuit REC2 is set shorter than the off response for smoothing in the first rectifying circuit REC1.

The operation will now be described.

When the first make contact points 1*a* and the semiconductor switch SW are both off prior to generation of the load drive signal IN, then when a high frequency signal is input from the signal generator SG to the transistor Q1, a light emitting diode PB1 of the first photocoupler PC1 is switched. At this time, since the break contact points 1*b* are on, this switch signal is received by the photodiode DB1, so that an AC signal is input to the voltage doubler rectifying circuit REC3, and a semiconductor switch off detection signal of logic value "1" is input from the voltage doubler rectifying circuit REC3 to the self hold circuit 11 as a trigger signal.

When in this condition, the load drive signal IN is input to the reset terminal of the self hold circuit 11, the electromagnetic relay RL is excited based on the self-hold output from the self hold circuit 11, so that the first and second make contact points 1*a* and 2*a* come on. When the second make contact points 2*a* come on, then an rectified output from the voltage doubler rectifying circuit REC4 based on the switching operation of the transistor Q2 is smoothed by the capacitor $C_O$ and then input to the one input terminal of the logical product operation circuit AND. Since the load drive signal IN is already input to the other input terminal thereof, then when the rectified output from the voltage doubler rectifying circuit REC4 is input, an output signal of logic value "1" is generated from the logical product operation circuit AND so that the semiconductor switch SW comes on via the second rectifying circuit REC2, and a load current is supplied to the load L.

With the fourth embodiment circuit, since a comparatively large current can flow in the break contact points 1*b* and the second make contact points 2*a* of the electromagnetic relay RL, then there is no problem with poor contact, and hence the silver cadmium oxide (AgCdO) contact points which are resistant to fusion faulting can be used.

INDUSTRIAL APPLICABILITY

The present invention improves the reliability of control systems concerned with safety and fitted with an electromagnetic relay. Safety when using industrial machinery and the like can therefore be improved, and the invention thus has considerable industrial applicability.

We claim:

1. An electromagnetic relay drive circuit which excites an electromagnetic relay depending on a high energy condition input signal of logic value "1" generated based on safety information, to thereby switch on relay contact points, said electromagnetic relay drive circuit comprising:

an electromagnetic relay having make contact points which switch on at the time of excitation and break contact points which switch on at the time of non excitation, said make contact points and break contact points being linked together to thus have a complementary relationship;

a self hold circuit which generates an output when a high energy condition trigger input signal of logic value "1" is input to a trigger terminal and said input signal is input to a reset terminal, and which holds said output while said input signal is input;

excitation output generating circuit which generates an excitation output for switching on said electromagnetic relay make contact points, based on said output from said self-hold circuit; and trigger-input signal generating circuit generating said trigger input signal, said trigger input signal generating circuit being coupled to the trigger terminal of said self hold circuit through said electromagnetic relay break contact points; and wherein said drive circuit includes a sending side and a receiving side connected by an external line portion, said external line portion comprising:

a first external line portion connecting said excitation output generating means and said electromagnetic relay to pass said excitation output, and a second external line portion respectively connecting one end of a series circuit of a resistor and said break contact points located on the receiving side and said trigger input signal generating circuit located on the sending side, and another end of said series circuit and the trigger terminal of said self hold circuit located on the sending side; and wherein said self hold circuit generates an output only when the respective signal levels of the reset input signal and the trigger input signal are within predetermined threshold value ranges previously set for each terminal.

2. An electromagnetic relay drive circuit according to claim 1, wherein trigger stabilizing means is disposed between the trigger terminal of said self hold circuit and the series circuit, for maintaining said trigger input signal within said threshold value range for a fixed period of time after said break contact points are opened.

3. An electromagnetic relay drive circuit according to claim 1, wherein said excitation output generating circuit comprises: an amplifier for amplifying an alternating current output from said self hold circuit; a transformer receiving an amplified output from said amplifier; and a rectifying circuit for rectifying an output from said transformer, and wherein said excitation output is generated by said rectifying circuit.

4. An electromagnetic relay drive circuit according to claim 1, wherein said electromagnetic relay make contact points are inserted in a load power supply circuit in series with a semiconductor switch, and said trigger input signal generating means generates a trigger input signal of logic value "1" when said semiconductor switch is off and said electromagnetic relay break contact points are on, the construction being such that when an output from said self hold means is generated due to input of said trigger input signal, said semiconductor switch comes on after said excitation output generating means excites said electromagnetic relay, while when the output from said self hold means stops, said electromagnetic relay is non-excited after said semiconductor switch goes off.

5. An electromagnetic relay drive circuit according to claim 4, wherein said trigger input signal generating means incorporates; semiconductor switch monitoring means wherein energy is supplied between contact points of said semiconductor switch so that when said semiconductor switch is off a receive signal level becomes a high level based on the supplied energy, and a switch off, detection signal of logic value "1" is generated, and when said semiconductor switch is on, the receive signal level becomes a low level based on the supplied energy, and the output becomes a logic value of zero and the switch off detection signal is stopped; and the arrangement is such that a logical product signal of the switch off detection signal of said semiconductor switch monitoring means, and a make contact points off detection signal based on switching on of said electromagnetic relay break contact points, is generated as a trigger input signal.

6. An electromagnetic relay drive circuit according to claim 5, wherein said semiconductor switch monitoring means incorporates a photocoupler for supplying energy between the contact points of said semiconductor switch and generating an alternating current light received output based on the supplied energy when said semiconductor switch is off, and a voltage doubler rectifying circuit for voltage doubler rectifying the alternating current output from said photocoupler, and wherein the rectified output from said voltage doubler rectifying circuit is said switch off detection signal.

7. An electromagnetic relay drive circuit according to claim 4, wherein an output to said electromagnetic relay and an output to said semiconductor switch, produced in said excitation output generating means, are supplied from the output of said self hold means via a transformer.

8. An electromagnetic relay drive circuit according to claim 7, wherein said excitation output generating means supplies an output from said transformer to said electromagnetic relay via a first rectifying circuit, and rectifies a part of the output from said transformer in a second rectifying circuit and supplies this as a control signal to said semiconductor switch via other make contact points of said electromagnetic relay provided separate from said make contact points, and wherein a discharge time constant of said first rectifying circuit is set larger than a discharge time constant of said second rectifying circuit.

9. An electromagnetic relay drive circuit according to claim 4, wherein said electromagnetic relay has second make contact points, arranged separate from first make contact points inserted in said load power supply circuit in series with the semiconductor switch and linked with said break contact points, and said trigger input signal generating means comprises a photocoupler for supplying energy between contact points of said semiconductor switch and generating an alternating current light received output based on the supplied energy when said semiconductor switch is off, and a voltage doubler rectifying circuit for voltage doubler rectifying the alternating current output from said photocoupler, the construction being such that an output terminal of said voltage doubler rectifying circuit is connected to the trigger terminal of said self hold circuit, and said break contact points are disposed between an output terminal of said light receiving element of said photocoupler and a power source so that the power source is connected to the light receiving element when said break contact points are on, and said excitation output generating means generates an excitation output for said electromagnetic relay via a transformer based on an output from said self hold circuit, and generates a control signal for said semiconductor switch by means of a logical product computation means which carries out a logical product operation on an output signal generated based on the switching on of said second make contact points, and said input signal.

* * * * *